US010358883B2

(12) United States Patent
Thomas et al.

(10) Patent No.: US 10,358,883 B2
(45) Date of Patent: Jul. 23, 2019

(54) MULTI-RUN RETRIEVABLE BATTERY PACK FOR ELECTRONIC SLICKLINE TOOLS

(71) Applicant: Halliburton Energy Services, Inc., Houston, TX (US)

(72) Inventors: Sean Gregory Thomas, Allen, TX (US); Jack Gammill Clemens, Fairview, TX (US); Matthew Craig Mlcak, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 141 days.

(21) Appl. No.: 15/124,857

(22) PCT Filed: May 21, 2014

(86) PCT No.: PCT/US2014/038910

§ 371 (c)(1),
(2) Date: Sep. 9, 2016

(87) PCT Pub. No.: WO2015/178901

PCT Pub. Date: Nov. 26, 2015

(65) Prior Publication Data

US 2017/0016293 A1 Jan. 19, 2017

(51) Int. Cl.
*E21B 23/01* (2006.01)
*E21B 41/00* (2006.01)
(Continued)

(52) U.S. Cl.
CPC ..... *E21B 23/01* (2013.01); *E21B 17/206* (2013.01); *E21B 29/00* (2013.01); *E21B 37/00* (2013.01);
(Continued)

(58) Field of Classification Search
CPC ..... E21B 23/00; E21B 43/00
See application file for complete search history.

(56) References Cited

U.S. PATENT DOCUMENTS 4,226,285 A 10/1980 Moseley, Jr.
4,790,380 A * 12/1988 Ireland ..... E21B 17/003 166/250.07
(Continued)

FOREIGN PATENT DOCUMENTS

GB 2293513 A 3/1996

OTHER PUBLICATIONS

International Search Report dated Feb. 25, 2015, issued in corresponding application No. PCT/US2014/038910, 2 pgs.

*Primary Examiner* — Brad Harcourt
*Assistant Examiner* — Steven A MacDonald
(74) *Attorney, Agent, or Firm* — Chamberlain Hrdlicka

(57) ABSTRACT

A downhole tool assembly includes a downhole tool and an anchor. The anchor is positionable at a downhole work site and includes a wet-connect port for engaging a battery pack. The tool operates until the battery runs low on power, when a low battery power alert is activated. The tool may be anchored at the work site while the battery is disconnected and retrieved to the surface for replacement. One or more charged batteries are then deployed and connected to the tool without having to remove the tool from the worksite or reposition the tool. The tool may be coupled to a wireline cable or a slickline cable or coiled tubing having a conductive wire for delivering low-voltage power to the tool. While the low-voltage power may not be adequate to operate the tool at full load, the power may be used to charge the tool during downtime.

6 Claims, 5 Drawing Sheets

(51) Int. Cl.

| | |
|---|---|
| ***E21B 17/20*** | (2006.01) |
| ***E21B 29/00*** | (2006.01) |
| ***E21B 37/00*** | (2006.01) |
| ***E21B 43/11*** | (2006.01) |
| ***E21B 47/12*** | (2012.01) |
| *E21B 31/00* | (2006.01) |
| *E21B 33/134* | (2006.01) |
| *E21B 43/12* | (2006.01) |
| *E21B 47/00* | (2012.01) |
| *E21B 47/06* | (2012.01) |
| *E21B 23/00* | (2006.01) |

(52) U.S. Cl.

CPC ..... *E21B 41/0085* (2013.01); *E21B 43/11* (2013.01); *E21B 47/12* (2013.01); *E21B 31/00* (2013.01); *E21B 33/134* (2013.01); *E21B 43/123* (2013.01); *E21B 47/0002* (2013.01); *E21B 47/06* (2013.01); *E21B 47/065* (2013.01); *E21B 2023/008* (2013.01)

(56) References Cited

U.S. PATENT DOCUMENTS 4,909,320 A * 3/1990 Hebert ..... E21B 29/02 166/361
5,353,872 A * 10/1994 Wittrisch ..... E21B 23/01 166/250.01
5,555,220 A * 9/1996 Minto ..... E21B 47/00 166/250.01
5,678,630 A 10/1997 Shaw et al.
6,454,011 B1 * 9/2002 Schempf ..... E21B 4/18 166/335
6,705,406 B2 3/2004 Das et al.
6,899,178 B2 5/2005 Tubel
6,945,330 B2 * 9/2005 Wilson ..... E21B 23/00 166/179
7,152,680 B2 12/2006 Wilson et al.
7,467,661 B2 12/2008 Gordon et al.
8,469,087 B2 6/2013 Gray
2003/0034163 A1 * 2/2003 Wilson ..... E21B 33/127 166/387
2003/0192692 A1 * 10/2003 Tubel ..... E21B 41/00 166/250.15
2007/0277980 A1 * 12/2007 Gordon ..... E21B 43/112 166/298
2010/0236777 A1 * 9/2010 Partouche ..... E21B 17/206 166/254.2
2011/0192596 A1 * 8/2011 Patel ..... E21B 17/028 166/250.11
2011/0214883 A1 * 9/2011 Patel ..... E21B 23/00 166/378
2013/0092372 A1 4/2013 Clapp et al.
2014/0131035 A1 5/2014 Entchev et al.

* cited by examiner

MULTI-RUN RETRIEVABLE BATTERY PACK FOR ELECTRONIC SLICKLINE TOOLS

TECHNICAL FIELD

The present disclosure relates generally to methods for deploying tools in hydro-carbon producing wells, and more specifically to methods and systems for deploying such a tool by slickline or wireline in conjunction with a battery pack.

DISCUSSION OF THE RELATED ART

Wells are drilled to a variety of depths to access and produce oil, gas, minerals, and other naturally-occurring deposits from subterranean geological formations. The drilling of a well is typically accomplished with a drill bit that is rotated within the well to advance the wellbore by removing topsoil, sand, clay, limestone, calcites, dolomites, or other materials to form a wellbore. The drill bit is typically attached to a drill string that may be rotated to drive the drill bit and through which drilling fluid, referred to as "drilling mud" or "mud", may be delivered downhole. The drilling mud is used to cool and lubricate the drill bit and downhole equipment and the circulating drilling mud also transports rock fragments and other cuttings to the surface of the well.

During or following the completion of a well, a well operator may deploy tools to repair or retrieve non-functional items from the wellbore or drill string or to accomplish discrete tasks, associated with the completion and maintenance of the well. Wireline and slickline assemblies may be used for deploying such tools. Providing power to the tools is important to ensure proper functionality while the tools are within the wellbore.

BRIEF DESCRIPTION OF THE DRAWINGS

Illustrative embodiments of the present disclosure are described in detail below with reference to the attached drawing figures, which are incorporated by reference herein and wherein.

Figure 1A:
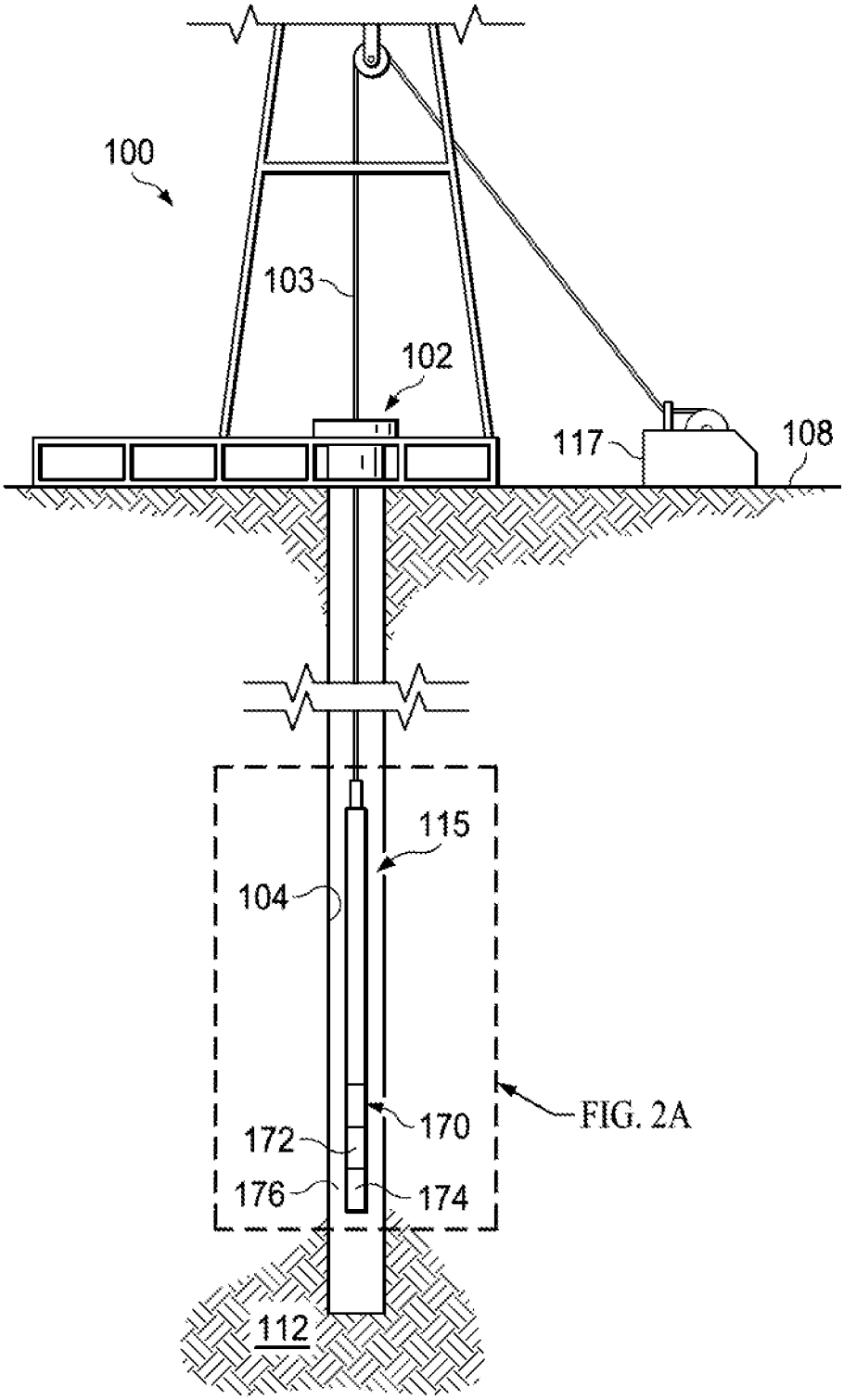
FIG. 1A is a diagram of an example slickline tool string having a tool, anchor, and a detachable battery pack deployed in wellbore in accordance with aspects of the present disclosure.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the systems, methods, and apparatuses described herein. It is understood that other embodiments may be utilized and that logical, structural, mechanical, electrical, and chemical changes may be made without departing from the spirit or scope of the disclosure. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

As noted above, during or following the completion of a well, a well operator may deploy tools to repair or retrieve non-functional items from the wellbore or drill string or to accomplish discrete tasks associated with the completion and maintenance of the well. For example, slickline tools may be deployed by first removing the drill string and then lowering the wireline and tools to an area of interest within the formation or by lowering the tools within the drill string.

As referenced herein, wireline-delivered tools are tools that are suspended from a wireline that is electrically connected to control systems at the surface of the well, usually for the purposes of gathering and conveying data about the formation, wellbore, or fluid in the wellbore. The wireline is typically a robust, braided cable that includes electrical or fiber cables for transmitting electrical power and data. The wireline may also be used to provide control signals to equipment in a wireline tool string. Slickline tools are similarly deployed into a wellbore but may not have an electrical connection to surface equipment. The slickline may be a single strand, unbraided wire such as a smooth, light-weight cable. Slickline and wireline tools may be deployed by first removing the drill string and then lowering the wireline and tools to an area of interest within the formation or by lowering the tools within the drill string itself.

A slickline may be used to deploy tools at any depth within a well. The slickline may be deployed from a truck-based spool or from a stationary spool that is deployed at the surface of the well and lowered by a motorized winch that is controlled by the well operator. The slickline may be lowered into the well through a sealed wellhead interface that maintains a pressure differential across the wellhead and prevents fluids from escaping the well during slickline operations.

Figure 1B:
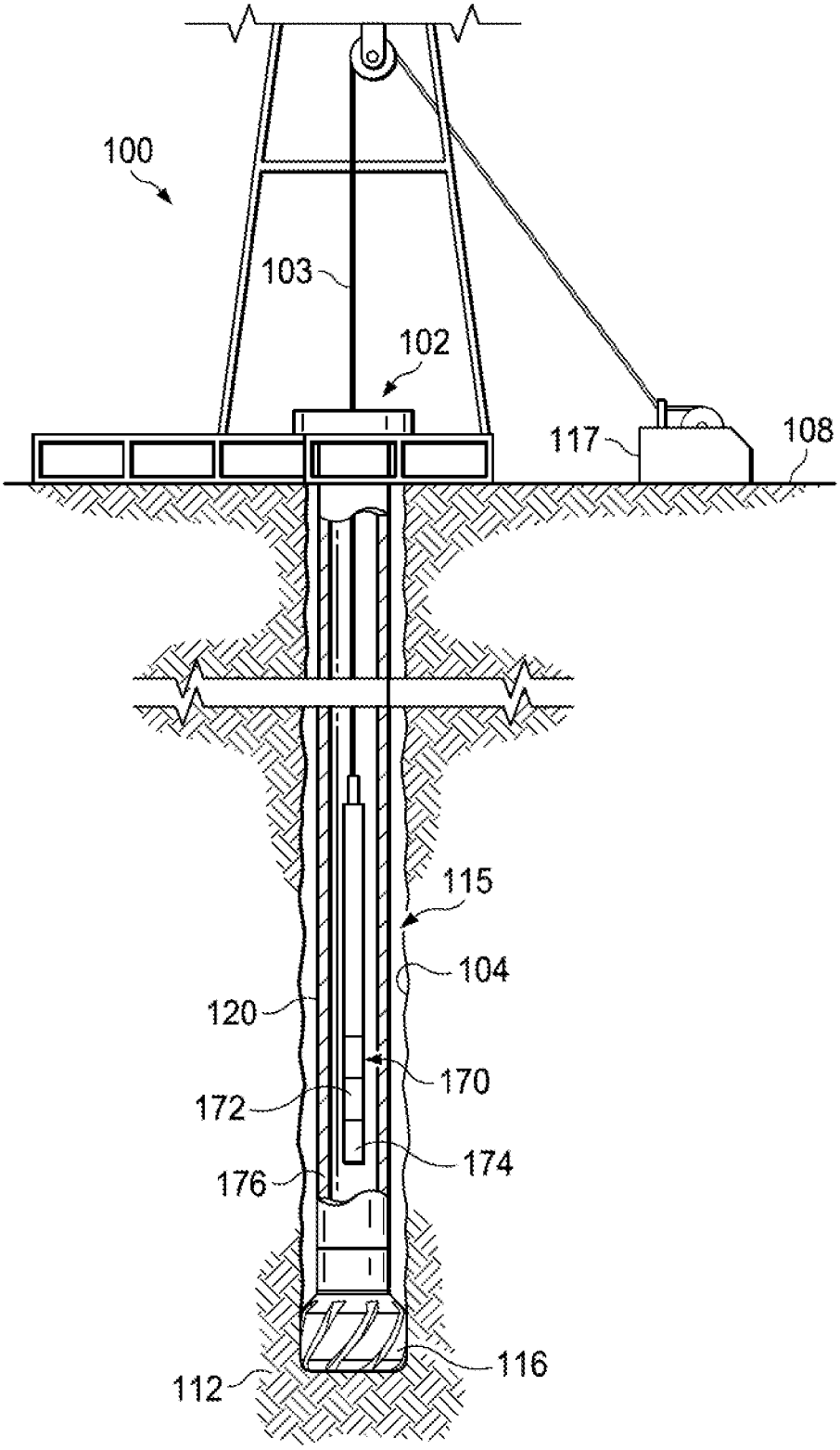
FIG. 1B is a diagram of an example slickline tool string having a tool, anchor, and a detachable battery pack deployed within a drill string in accordance with aspects of the present disclosure.

The slickline cable and an associated tool string may be deployed within a drill string, as shown in FIG. 1B, or within a cased or uncased well, as shown in FIG. 1A. In a typical deployment, the well operator controls a slickline tool using a mechanical interface, as a typical slickline deployment does not include the transfer of electrical power via the slickline. The slickline cables and tool strings described herein, however, may include a power transmission line embedded therein to provide at least a low voltage source of power and a line of communication for transmitting control signals and other data.

To provide power downhole for tools that operate using electric power, a battery pack may be deployed with the tool. The battery pack may be adapted to provide electric power to adjacent tools or couplings from batteries enclosed within the battery pack. Such batteries may be alkaline batteries, lithium-ion batteries, or any other suitable type of battery.

A number of tools may be deployed to or retrieved from a wellbore using a slickline cable. For example, slickline cables may be used to deploy downhole power units, tubing perforators, fishing tools, bridge plugs, gas lift valves, gauge hangers, and logging tools, including, for example, a camera. Similarly, a number of well operations may be executed using a slickline. For example, slickline operations may include setting or pulling plugs and chokes that either isolate or reduce the flow rate of discrete regions of the well, setting and pulling gas lift valves, logging pressure and temperature measurements within the wellbore, running other logging tools into the well, and removing paraffins.

A slickline tool system is disclosed herein that provides power to a downhole tool. The downhole tool may be set in tubing, a wellbore, or a well casing by an anchor, which may be an expanding anchor, a profile that engages a landing nipple, or any other suitable securing mechanism. For example, the anchor may be an elastomeric or metallic expanding element, a tractor, or a similar device that anchors a tool by expanding a metallic or elastomeric gripping element to engage an inner diameter of tubing, a well casing, or a wellbore wall. Alternatively, the anchor may be a profile that engages a landing nipple that has been run into the well on the completion tubing or other tubing to provide a specific landing location for downhole tools. Landing nipples may have common, universal profiles and may be installed at multiple locations within a well to provide multiple anchor points. The profile may include a lock mandrel that is coupled to the downhole tool to engage the landing nipple to anchor the tool.

In conventional slickline deployments, it may not be feasible to deploy electric tools beyond a certain depth because such tools are powered by batteries, and available battery power may be limited as a result of limitations of the slickline cable. For example, the slickline may have a limited carrying capacity that limits the ability to lower a heavier, higher-capacity battery using the slickline cable that also supports the weight of the cable.

In contrast, the embodiments disclosed herein provide the tool may include or be coupled to an anchor that functions as a component of the downhole tool. The downhole tool or system may also include a detachable battery pack that can be disconnected from the tool or anchor, quickly retrieved to the surface, and replaced with a newly charged battery pack that returns to the tool.

In some embodiments, a battery-powered slickline tool is anchored in the well at a work site to, for example, cut, mill, or clean a portion of the wellbore. Yet such processes might require significant power over an extended period of time to complete. To facilitate the rapid completion of such processes, a slickline tool system includes a retrievable and replaceable battery pack that may be quickly replaced to minimize well downtime in the event the battery pack begins to lose its charge. The battery pack may be attached to an anchor that, in turn, fixes the battery-powered slickline tool at the downhole worksite. While the tool remains anchored, the battery pack may be quickly replaced without the need for excessive down time.

In an embodiment, the slickline tool system includes a downhole power delivery system that includes a slickline cable having an embedded power supply cable that transmits power to a low-voltage, downhole tool or battery pack. While the voltage of the power supply cable is non-limiting, in one embodiment the voltage of the power supply cable is up to 1 kV. In another embodiment, the power supply cable has a voltage of up to 100V. The slickline tool system also includes an anchor that couples to the downhole tool and a detachable battery pack. The tool, anchor and battery pack may be delivered to a work site for operation as part of a slickline tool string. The tool may be a cutter, cleaner, stroker or other downhole tool that is coupled to the anchor and powered by the battery pack, which is also coupled to the anchor on the opposing side of the anchor from the tool. The battery pack is detachable from and re-attachable to the anchor via a wet connect interface so that, while the anchor and tool remain deployed, the battery pack may be retrieved, replaced, and reattached to the anchor to supply power to the tool without having to reposition the tool.

Referring now to the figures, FIGS. 1A-1B show an illustrative embodiment of a downhole system 100 that includes a slickline tool string 115 having a slickline tool 174 that is coupled to an anchor 172 and battery pack 170. It is noted that while a slickline cable 103 is shown as the tool string conveyance, the slickline tool 174, anchor 172, and battery pack 170 may similarly be deployed using coiled tubing or a wireline conveyance. The downhole system 100 is used in a well 102 having a wellbore 104 that extends from a surface 108 of the well to or through a subterranean geological formation 112. The well 102 is illustrated onshore in FIG. 1A, with the system 100 being deployed in a land-based well. Alternatively, the system 100 may be deployed within a drill string 120 above or proximate to a drill bit 116, as shown in FIG. 1B. The slickline tool string 115 includes a winch 117 to lift and lower a downhole portion of the slickline tool string 115 into the well. In still another embodiment, the system 100 may be deployed in a subsea well 119 accessed by a fixed or floating platform 121. FIGS. 1A-1B each illustrate these possible uses of the system 100, and the following description of the system 100 and slickline tool string 115 having a detachable battery pack 170 may be useful in any similar downhole environment. Similar components in FIGS. 1A-1B are identified with similar reference numerals.

In the embodiment illustrated in FIG. 1B, the well 102 has been partially or completely formed by a drilling process in which the drill bit 116 is turned by the drill string 120 that extends the drill bit 116 from the surface 108 to the bottom of the well 102. The drill string 120 may be made up of one or more connected tubes or pipes of varying or similar cross-section. The drill string 120 may refer to the collection of pipes or tubes as a single component, or alternatively to the individual pipes or tubes that comprise the string. The term drill string is not meant to be limiting in nature and may refer to any component or components that are capable of transferring energy from the surface of the well to the drill bit. In several embodiments, the drill string 120 may include a central passage disposed longitudinally in the drill string and capable of allowing fluid communication between the surface of the well and downhole locations.

Using the winch 117, the slickline tool 174 may be lowered to a worksite 176 within a wellbore 104, well casing, or drill string 120. The slickline tool 174 may be any suitable slickline tool that is usable at the worksite. Such tools may include a bridge plug, a downhole power unit that actuates another device (such as a bridge plug, packer, or perforator), a collar locator, a cutter, a cleaner, a running tool or pulling tool, a camera, a wire finder, a test tool, a positioning tool, a bailer, a measurement probe (such as a pressure sensor, temperature sensor, or chemical sensor) or any combination of the foregoing, along with mechanical tools that may be operated without electric power.

Figure 2A:
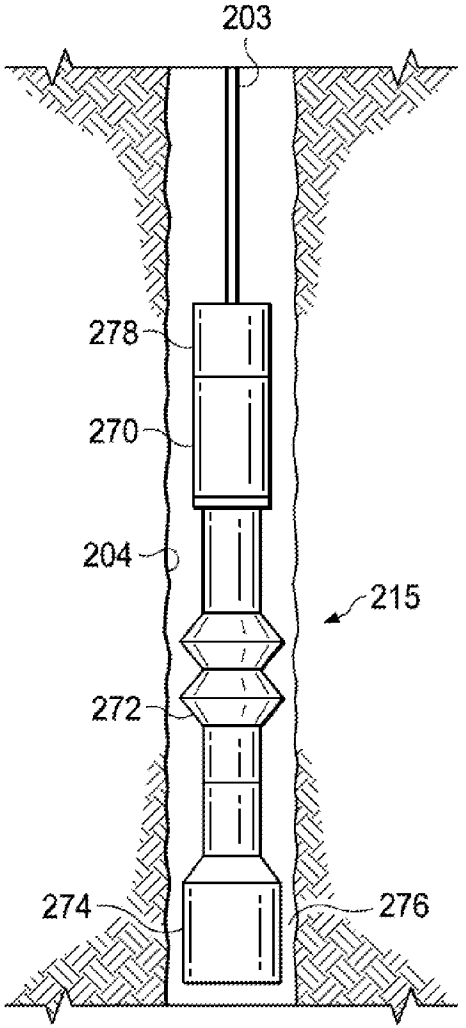
FIG. 2A is a diagram showing an example tool, anchor, and detachable battery pack deployed to a work site in accordance with aspects of the present disclosure.
Figure 2B:
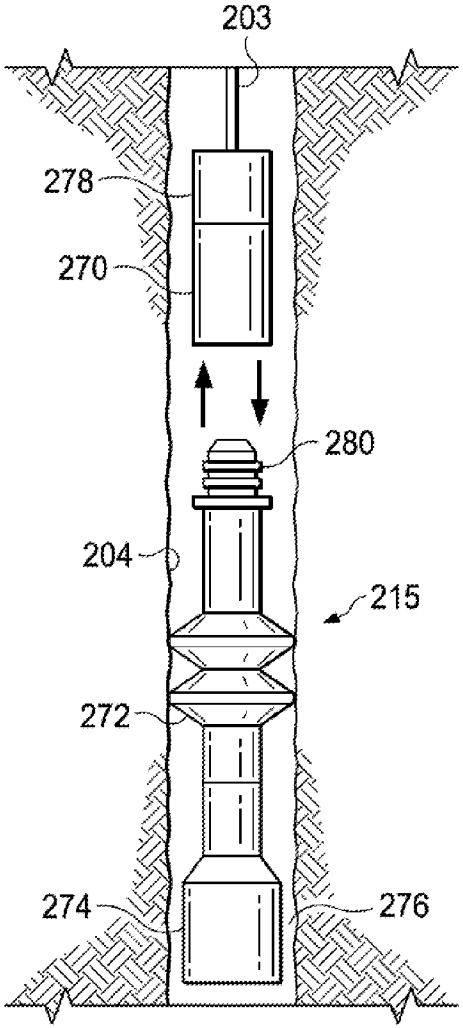
FIG. 2B is a diagram showing the example tool, anchor, and detachable battery of FIG. 2A in which the battery pack is disconnected and the tool and anchor remain deployed at the work site in accordance with aspects of the present disclosure.
Figure 2C:
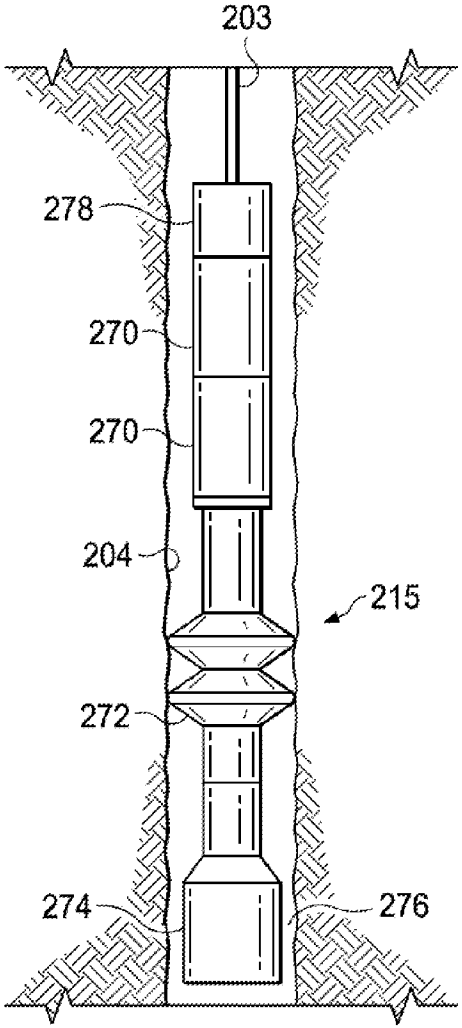
FIG. 2C is a diagram showing the example tool, anchor, and detachable battery pack of FIG. 2A in which the battery pack is reconnected to the tool and anchor at the work site in accordance with aspects of the present disclosure.

Exemplary deployments of a slickline tool string 215 that are analogous to the slickline tool string 115 are described in more detail with regard to FIGS. 2A-2C. In the embodiment of FIG. 2A, the slickline tool string 215 is deployed within a wellbore 204 by slickline cable 203. The slickline tool string 215 includes a tool 274, which may be any of the types of tools mentioned above, in addition to an anchor 272 and a battery pack 270. A coupler 278 couples the slickline cable 203 to the battery pack 270. Each of the foregoing couplings may be any that can be mechanically or electromechanically actuated by a well operator, including a wet connect, which is an electrical coupling that can be made while submersed in well fluid.

In an embodiment, a wet connect interface is present between the tool 274 and anchor 272, between the anchor 272 and battery pack 270, and between the battery pack 270 and coupling 278. Like the wet connect interfaces, the anchors 272 may also be actuated in response to a mechanical or electrical signal.

In an embodiment, the batteries of the battery pack 270 may be charged by a low-voltage power supply cable that delivers low-voltage power to a power supply included as a discrete module in the tool string 215 or as a component of the battery pack 270. In such an embodiment one or more of the battery packs 270 may include the power supply. In addition, the power supply may include voltage converter, which may also be referred to as a voltage multiplier, to convert the low-voltage power received from the supply cable to the charge needed to charge the batteries. In an embodiment in which multiple battery packs 270 are stacked together, the power supply may be included as a module that sits atop or is embedded within the topmost battery pack 270 to provide electrical energy at a consistent power level to each of the battery packs 270. Alternatively, each battery pack 270 may include such a power supply.

The slickline cable 203 may be configured to convey an electrical current or a data signal by, for example, embedding a conductive wire therein as described in more detail below with regard to FIGS. 4A-4F. As such, the slickline cable 203 provides a conveyance for transferring control signals to components in the slickline tool string 215, for conveying electrical energy to such components, and for conveying data from components in the slickline tool string 215 to the surface. In some embodiments, however, the slickline cable 203 deployment and actuation of the anchor 272 and couplings 278 may be purely mechanical.

In an embodiment in which the slickline cable 203 conveys data, any suitable type of telemetry may be employed. For example, power line communication or a similar communications protocol may be used to modulate a data signal for conveyance over a power transmission wire or cable that is included within the slickline cable 203.

The battery pack 270 may be a retrievable battery pack that is retrievable to the surface where it can be replaced by a fresh battery pack that can be rapidly redeployed to power the tool 274. In such an embodiment, the tool 274 may be deployed to the worksite 276 substantially as shown in FIGS. 2A-2C. The tool 274 may be operated at the worksite 276 until power within the battery pack 270 is depleted. Before or at the time the battery pack's power is depleted, the anchor 272 is actuated to engage the wall of the wellbore 204 to fix the location of the tool 274, which may be in the process of completing a task, at the worksite. The anchor 272 may be actuated to engage the wellbore 204 by any means. In one embodiment, the anchor 272 includes barrel slips that mechanically engage the wellbore 204 when the anchor is in the radially expanded configuration. In another embodiment, the anchor 272 includes a packing assembly that sealingly engages the wellbore 204 when the anchor 272 is in the radially expanded configuration. In yet another embodiment, the anchor 272 engaged the wellbore 204 by use of a spring assembly that stores energy when the anchor 272 is in the radially expanded configuration.

Once the anchor 272 is set, the battery pack 270 may be decoupled from the anchor 272 and retrieved to the surface where the battery pack 270 may be replaced. In one embodiment, the decoupling occurs by asserting physical force from the surface via the wireline. In another embodiment, the battery pack 270 is self-releasing by use of mechanical means or electrical means. After a replacement battery pack 270 is attached to the coupling 278 of the slickline cable 203 at the surface, the battery pack 270 is returned to the worksite 276 and connected to the tool 274 via a wet connect coupling 280 at the anchor 272 to power the tool 274. Once the replacement battery pack 270 is coupled to the tool 274, the tool 274 may resume operation without having to be repositioned.

The battery pack 270 may include at its base a complementary wet connect interface to the wet connect interface 280 of the anchor 272 may also include a wet connect interface to engage the coupling 278. The wet connect 280 may be any which is either self-releasing or removable by asserting physical force form the surface via the wireline. In certain embodiments, the battery pack 270 may be a stackable battery pack 270 so that multiple battery packs 270 may be connected together in series to provide additional or extended power to a tool 274 at a worksite 276. Some or all of the battery packs may have one or more wet connect interfaces that allow the battery packs to be stacked and used interchangeably with the tool 215. Moreover, since the battery packs 270 may be delivered incrementally to the anchored tool 274 at the worksite 276 in separate trips, heavier combinations of tools 274 and battery packs 270 may be delivered to the worksite 276 without the need of a more robust slickline cable 203.

In addition, the decoupling of the anchor 272 and tool 274 from the battery pack 270 may make it easier for the battery pack or batteries 270 to be rapidly retrieved to the surface for replacement without the need for removing the entire tool string 215 from the wellbore 204. As a result, the battery pack 270 may spend less time at the worksite 276 within the wellbore 204. Moreover, the worksite 276, which is downhole, is likely to be at a relatively high temperature compared to the temperature at the surface. Such higher temperatures may negatively affect battery performance and durability, and the ability to rapidly retrieve the battery pack 270 from the wellbore 204 may be used to enhance and lengthen battery life and performance by shortening the amount of time the battery pack 270 is deployed on the wellbore 204.

In an embodiment, the tool 274 includes a controller, sensors, communications interface, and a transceiver for gathering data related to usage of the tool 274 and the power level of batteries in the battery packs 270. In such an embodiment, the data gathered by the tool 274 may be transmitted to the surface for analysis by a well operator. The data may also be used to automatically and efficiently manage power in the battery packs 270 by enabling the charging of batteries enclosed within the battery packs 270 using current received from the slickline cable 203 when the tool 274 is not operating. To implement such a system, each battery pack 270 may also include a similar combination of controllers sensors, communication interfaces, and transceivers so that one or more of the battery packs 270 may cooperate with the tool 274 to efficiently manage power in the batteries.

The tool 274 controller is a processor or microcontroller that is integrated into the tool and controls one or more mechanical or electrical actions of the tool. In one embodiment, the controller intakes data from one or more sensors and uses this data to determine the next step mechanical or electrical action for the tool to take. The controller may also transmit data received from the sensors to the surface for analysis. The controller may comprise a set of instructions that when executed cause the controller to receive an output signal from the sensor, determine a power level of the battery pack, compare the determined power level to a pre-determined threshold, and if the power level is below the threshold, actuate the expandable anchor.

Figure 3:
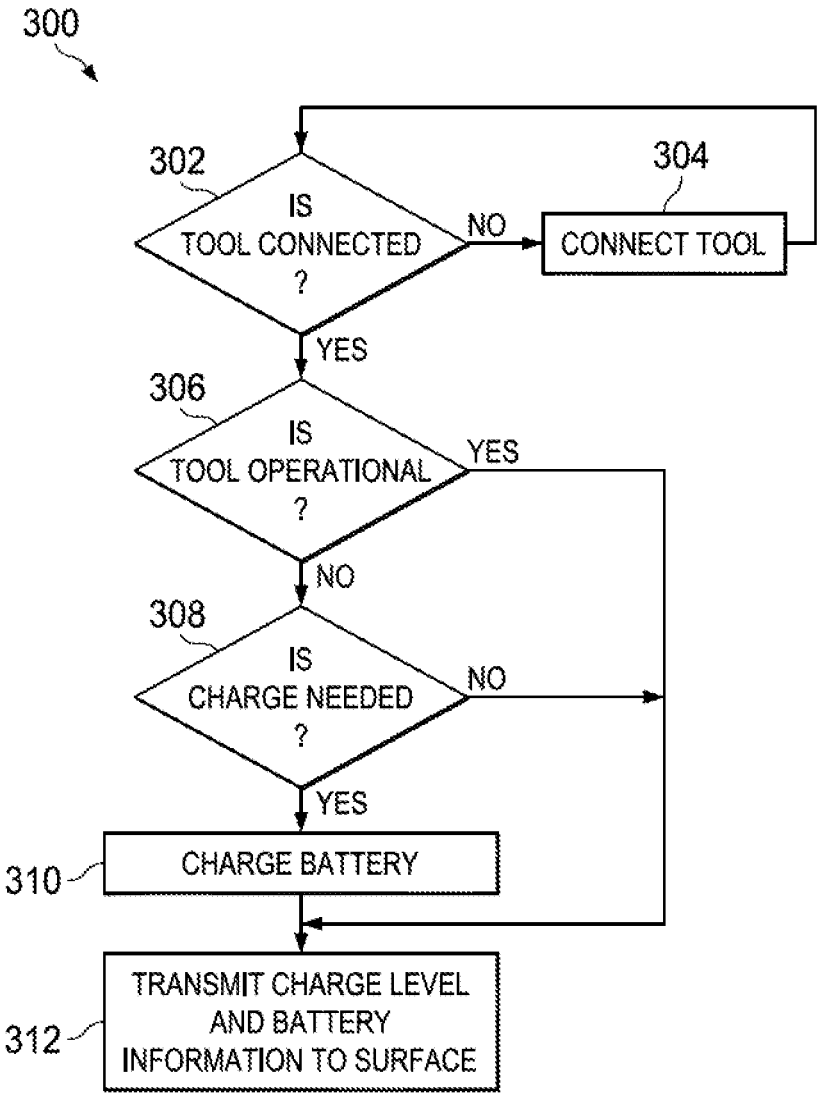
FIG. 3 is a flowchart showing an example process for charging a battery using a low-voltage power source via a slickline cable in accordance with aspects of the present disclosure.

A process 300 for managing power in the batteries is shown in the flowchart of FIG. 3. The steps and decisions of the process 300 may be determined or controlled by either the controller of the tool, or by a processor or microcontroller located at the surface. The process 300 includes determining whether a tool is connected to the battery pack 302. To make this determination 302, sensor data from one or more components of the tool may be sent to either the controller of the tool, or by a processor or microcontroller located at the surface. This determination may be useful insofar as it may provide additional confirmation to a well operator that a tool is properly connected to a tool string and is coupled to a powered battery pack. If the tool is determined not to be coupled to a battery pack, the next step in the process 300 may be to connect the tool 304 and repeat the determination 302 to ensure that the tool is properly connected to the battery pack. The tool may be connected to the battery pack by use of by an anchor, and in response to a mechanical or electrical signal received from the controller of the tool or from a processor or microcontroller located at the surface.

The process 300 may also include determining whether the tool is operational 306. The determination 306 occurs by either the controller at the tool, or a processor or microcontroller located at the surface, in response to commands sent to and/or sensor information received from components of the tool. For example, the tool may not be considered operational if the anchor does not retract in response to commands from a tool controller, or a surface processor or microcontroller. In another example, the tool may not be considered operation if the battery is not maintaining its required voltage. If the tool is operational, and the process 300 may proceed to transmit data indicating the battery charge level and other data to the surface 312.

In an optional step (not shown), if the tool is operational, the charge on the battery may be monitored until it is sufficiently low or drops below a predetermined threshold. When a low charge is detected, an alarm may be provided to a well operator to give the operator the opportunity to anchor the tool before battery power is completely dissipated. Alternatively, detection of a low power level may cause the system to automatically anchor the tool before power is completely dissipated. Such other data may include indicia relating to the health of the battery, such as the battery's capacity, or other data received from the tool, such as tool usage data or data received from logging or similar sensors at the tool. If the tool is not determined to be operational, then the process 300 proceeds to determine if a charge is needed 308 at the batteries, and the batteries may charge 310 instead of supplying power to the tool. In an embodiment, the batteries may be charged by a low-voltage power supply cable that delivers low-voltage power to the battery packs, as described previously. When charging, the process 300 may still include transmitting charge level and other information to the surface 312, as mentioned above. This process 300 may be used to efficiently manage power within the tool string by taking advantage of any tool downtime. For example, the battery packs may charge at any time the tool is not operational, such as during periods of inactivity or during transport periods when the tool is being moved from one location in the wellbore to another.

Example embodiments of "smart" slickline cable that may be used to deploy a slickline tool system that conveys power and transmits data via the slickline cable are shown in FIGS. 4A-4F. In the various embodiments, any suitable cable profile (cross-section) may be used, and the slickline cable may be formed with a groove or detent for housing an embedded power transmission wire. For example, the slickline cable may be a steel cable having an outer diameter of 0.092-0.16 inches, or any other suitable diameter. The power transmission wire may be any suitable conductive wire, and may include one or more wires. In an embodiment, the power transmission wire may also be insulated to prevent loss of power to the slickline cable. In some embodiments, the power transmission wire may also be co-extruded or otherwise embedded within the slickline cable so that the slickline cable may maintain traditional shapes and dimensions that are typically associated with slickline deployments.

Figure 4A:
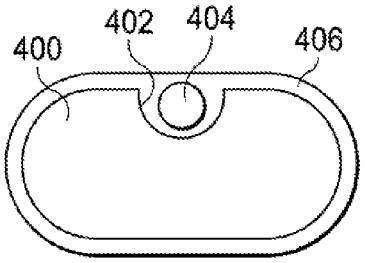
FIGS. 4A-4F are diagrams showing examples of slickline cables that include power or data transmission lines in accordance with aspects of the present invention.

In FIG. 4A, for example, the slickline cable 400 has an oval profile and a groove 402 that houses the power transmission cable 404. An optional protective layer 406 may also be included to provide additional insulation to the power transmission cable 404 and to smooth the profile of the slickline cable 400.

Figure 4B:
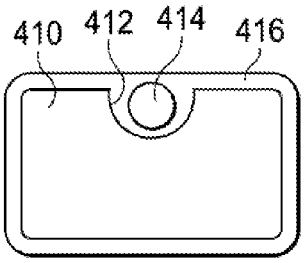

In FIG. 4B, the slickline cable 410 has a rounded, rectangular profile and a groove 412 that houses the power transmission cable 414. An optional protective layer 416 may also be included to provide additional insulation to the power transmission cable 414 and to smooth the profile of the slickline cable 410.

Figure 4C:
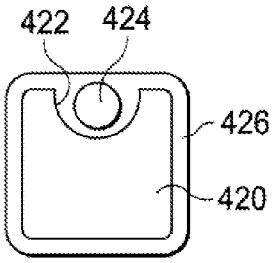

In FIG. 4C, the slickline cable 420 has a rounded, square profile and a groove 422 that houses the power transmission cable 424. An optional protective layer 426 may also be included to provide additional insulation to the power transmission cable 424 and to smooth the profile of the slickline cable 420.

Figure 4D:
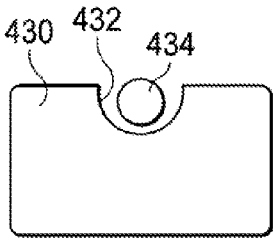
Figure 4E:
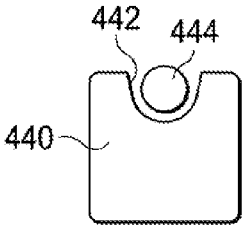

In FIG. 4D, the slickline cable 430 has an angular, rectangular profile and a groove 432 that houses the power transmission cable 434, and in In FIG. 4E, the slickline cable 440 has an angular, square profile and a groove 442 that houses the power transmission cable 444.

Figure 4F:
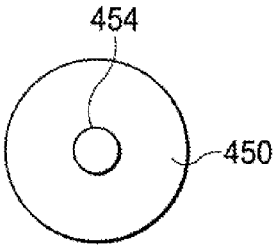

In FIG. 4F, the exemplar slickline cable 440 has a round profile and a power transmission cable 444 that is coextruded with the slickline cable 440. In an embodiment, an insulating layer may be included between the body of the slickline cable 440 and power transmission cable 444 to ensure the efficient transfer of power and/or data via the power transmission cable 444.

The illustrative systems, methods, and devices described herein may also be described by the following examples:

Example 1

A tool assembly includes a downhole tool string having a downhole tool, an anchor operable to position the downhole tool within a wellbore, and a battery pack. The anchor includes a wet connect port for engaging the battery pack.

Example 2

A tool assembly includes a downhole tool string having a downhole tool, an anchor operable to position the downhole tool within a wellbore, and a battery pack. The anchor includes wet connect port for engaging a battery pack that is detachable from and re-attachable to the anchor.

Example 3

A tool assembly includes a downhole tool string having a downhole tool, an anchor operable to position the downhole tool within a wellbore, and a battery pack. The anchor includes wet connect port for engaging a battery pack. The tool assembly further includes a slickline cable having an embedded, low-voltage power supply cable, and the tool string includes a power supply. The power supply includes a voltage converter that is operable to convert electrical power from a first voltage received from the low-voltage power supply cable to a second voltage that corresponds to the charging voltage of the battery pack.

Example 4

A tool assembly includes a downhole tool string having a downhole tool, an anchor operable to position the downhole tool within a wellbore, and a battery pack. The anchor includes wet connect port for engaging a battery pack. The battery pack is a retrievable, stackable battery pack.

Example 5

A tool assembly includes a downhole tool string having a downhole tool, an anchor operable to position the downhole tool within a wellbore, and a battery pack. The anchor includes wet connect port for engaging a battery pack. The downhole tool also includes a sensor operable to determine when the battery pack's power has dropped below a predetermined threshold, and is operable to generate a control signal to actuate the anchor in response to such determination.

Example 6

A tool assembly includes a downhole tool string having a downhole tool, an anchor operable to position the downhole tool within a wellbore, and a battery pack. The anchor includes wet connect port for engaging a battery pack. The downhole tool is a stroker, cutter, a cleaner, or a perforator, which may be a perforation gun, or punch and blade style perforator.

Example 7

A tool assembly includes a downhole tool string having a downhole tool, an anchor operable to position the downhole tool within a wellbore, and a battery pack. The anchor includes wet connect port for engaging a battery pack. A tractor or similar devices operates as the anchor.

Example 8

A slickline power delivery system includes a slickline cable having an embedded, low-voltage power supply cable, a power supply, a retrievable battery pack, and a downhole tool. The downhole tool includes an anchor operable to position the downhole tool within a wellbore.

Example 9

A slickline power delivery system includes a slickline cable having an embedded, low-voltage power supply cable, a power supply, a retrievable battery pack, and a downhole tool. The downhole tool includes an anchor operable to position the downhole tool within a wellbore. The battery pack is detachable from and re-attachable to the anchor.

Example 10

A slickline power delivery system includes a slickline cable having an embedded, low-voltage power supply cable, a power supply, a retrievable battery pack, and a downhole tool. The downhole tool includes a cutter and an anchor operable to position the downhole tool within a wellbore.

Example 11

A slickline power delivery system includes a slickline cable having an embedded, low-voltage power supply cable, a power supply, a retrievable battery pack, and a downhole tool. The downhole tool includes a wellbore or casing cleaner and an anchor operable to position the downhole tool within a wellbore.

Example 12

A slickline power delivery system includes a slickline cable having an embedded, low-voltage power supply cable, a power supply, a retrievable battery pack, and a downhole tool. The downhole tool includes a perforator and an anchor operable to position the downhole tool within a wellbore.

Example 13

A slickline power delivery system includes a slickline cable having an embedded, low-voltage power supply cable, a power supply, a retrievable battery pack, and a downhole tool. The downhole tool includes a tractor that is capable of operating as an anchor operable to position the downhole tool within a wellbore.

Example 14

A slickline power delivery system includes a slickline cable having an embedded, low-voltage power supply cable, a power supply, a retrievable battery pack, and a downhole tool. The downhole tool includes an anchor operable to position the downhole tool within a wellbore. The slickline power delivery system further includes a plurality of battery packs connected in series.

Example 15

A slickline power delivery system includes a slickline cable having an embedded, low-voltage power supply cable, a power supply, a retrievable battery pack, and a downhole tool. The downhole tool includes an anchor operable to position the downhole tool within a wellbore. The slickline cable includes a groove and the low-voltage power supply cable is disposed within the groove.

Example 16

A slickline power delivery system includes a slickline cable having an embedded, low-voltage power supply cable, a power supply, a retrievable battery pack, and a downhole tool. The downhole tool includes an anchor operable to position the downhole tool within a wellbore. The slickline cable and low-voltage power supply cable are co-extruded, and the slickline cable further includes an insulating layer between the slickline cable material and the low-voltage power supply cable.

Example 17

A method of operating a slickline tool assembly includes deploying a downhole tool using a slickline. The downhole tool has an anchor operable to position the downhole tool within a wellbore and a port for engaging a detachable/re-attachable battery pack. The port is a wet connect port.

Example 18

A method of operating a slickline tool assembly includes deploying a downhole tool using a slickline. The downhole tool has an anchor operable to position the downhole tool within a wellbore and a port for engaging a detachable/re-attachable battery pack. The port is a wet connect port and the conveyance is a slickline cable having a low-voltage power supply cable embedded therein. The battery pack includes a power supply having a voltage converter that is operable to convert electrical power from a first voltage received from the low-voltage power supply cable to a second voltage that corresponds to the charging voltage of the battery pack.

Example 19

A method of operating a slickline tool assembly includes deploying a downhole tool using a slickline. The downhole tool has an anchor operable to position the downhole tool within a wellbore and a port for engaging a detachable/re-attachable battery pack. The port is a wet connect port and the downhole tool is a cutter.

Example 20

A method of operating a slickline tool assembly includes deploying a downhole tool using a slickline. The downhole tool has an anchor operable to position the downhole tool within a wellbore and a port for engaging a detachable/re-attachable battery pack. The port is a wet connect port and the downhole tool is a cleaner.

Example 21

A method of operating a slickline tool assembly includes deploying a downhole tool using a slickline. The downhole tool has an anchor operable to position the downhole tool within a wellbore and a port for engaging a detachable/re-attachable battery pack. The port is a wet connect port and the downhole tool is a perforator.

Example 22

A method of operating a slickline tool assembly includes deploying a downhole tool using a slickline. The downhole tool has an anchor operable to position the downhole tool within a wellbore and a port for engaging a detachable/re-attachable battery pack. The port is a wet connect port and the downhole tool includes a tractor that functions as the anchor.

It should be apparent from the foregoing that systems, methods, and apparatuses having significant advantages over the state of the art has been provided. While the illustrative embodiments are shown in only a few forms, the disclosure is not limited to only these embodiments and is susceptible to various changes and modifications without departing from the spirit thereof.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, integers, steps, operations, elements, and/or components, but do not preclude the presence or addition of one or more other features, integers, steps, operations, elements, components, and/or groups thereof. The corresponding structures, materials, acts, and equivalents of all means or step plus function elements in the claims below are intended to include any structure, material, or act for performing the function in combination with other claimed elements as specifically claimed. The description of the illustrative embodiments has been presented for purposes of illustration and description but is not intended to be exhaustive or limited to the disclosed embodiments. Many modifications and variations will be apparent to those of ordinary skill in the art without departing from the scope and spirit of the disclosure. The scope of the claims is intended to broadly cover the disclosed embodiments and any such modifications

The invention claimed is:

1. A tool assembly for use downhole in a wellbore at a downhole worksite, comprising:

a downhole tool string comprising a downhole tool, an expandable anchor coupled to the downhole tool, and a retrievable battery pack removably coupled to at least one of the downhole tool and the expandable anchor, wherein the downhole tool string is deployable to the downhole worksite with the downhole tool coupled to the anchor and the battery pack, and wherein the battery pack is removable from the downhole tool with the anchor expanded to anchor the downhole tool at the downhole worksite;

wherein, the battery pack comprises a down-hole facing side and an up-hole facing side, and the down-hole side of the battery pack comprises a battery port, and the expandable anchor comprises a down-hole facing side and an up-hole facing side, wherein the up-hole facing side comprises an anchor port complementary to the battery port.

2. The tool assembly of claim 1, wherein the battery pack comprises a slickline connector interface.

3. The tool assembly of claim 1, further comprising a slickline cable having an embedded, low-voltage power supply cable, wherein the downhole tool string comprises a power supply having a voltage converter that is operable to convert electrical power from a first voltage received from the low-voltage power supply cable to a second voltage that corresponds to the charging voltage of the battery pack.

4. The tool assembly of claim 1, further comprising:

at least one additional battery pack;

wherein the battery pack and each additional battery pack comprise a downhole facing side and an uphole facing side, each downhole facing side comprising a downhole wet-connect port and each uphole facing side comprising an uphole battery wet-connect port that is configured to mate and couple to the downhole wet-connect port; and wherein the battery pack is coupled to at least one additional battery pack.

5. The tool assembly of claim 1, wherein the downhole tool further comprising a sensor electrically coupled to the battery pack, and a controller communicably coupled to the sensor, wherein the controller comprises a set of instructions that when executed cause the controller to receive an output signal from the sensor, determine a power level of the battery pack, compare the determined power level to a pre-determined threshold, and if the power level is below the threshold, actuate the expandable anchor.

6. The tool assembly of claim 1, wherein the downhole tool is selected from the group consisting of a cutter, a cleaner, a perforator, and a logging tool.

* * * * *